US009683701B2

(12) United States Patent
Sommardal

(10) Patent No.: US 9,683,701 B2
(45) Date of Patent: Jun. 20, 2017

(54) TANK

(71) Applicant: LNGTAINER AB, Helsinki (FI)

(72) Inventor: Tom Sommardal, Helsinki (FI)

(73) Assignee: LNGTAINER AB, Helsinki (FI)

( * ) Notice: Subject to any disclaimer, the term of this patent is extended or adjusted under 35 U.S.C. 154(b) by 14 days.

(21) Appl. No.: 14/412,677

(22) PCT Filed: Jun. 13, 2013

(86) PCT No.: PCT/FI2013/000027
§ 371 (c)(1),
(2) Date: Jan. 4, 2015

(87) PCT Pub. No.: WO2014/006265
PCT Pub. Date: Jan. 9, 2014

(65) Prior Publication Data

US 2015/0159807 A1 Jun. 11, 2015

(30) Foreign Application Priority Data

Jul. 3, 2012 (FI) ..... 20125769

(51) Int. Cl.
*F17C 1/12* (2006.01)
*F17C 1/00* (2006.01)
(Continued)

(52) U.S. Cl.
CPC ..... *F17C 1/12* (2013.01); *F17C 1/005* (2013.01); *F17C 1/16* (2013.01); *F17C 3/06* (2013.01); *F17C 2201/0157* (2013.01); *F17C 2201/035* (2013.01); *F17C 2201/052* (2013.01); *F17C 2203/0304* (2013.01); *F17C 2203/0354* (2013.01); *F17C 2203/066* (2013.01); *F17C 2203/0619* (2013.01); *F17C 2203/0636* (2013.01); *F17C 2203/0639* (2013.01); *F17C 2203/0663* (2013.01);
(Continued)

(58) Field of Classification Search
CPC .... F17C 1/12; F17C 1/005; F17C 1/16; F17C 3/06; F17C 2270/0105; F17C 2203/0329; F17C 2203/0629; F17C 2223/0153; F17C 2260/035; F17C 2265/032; F17C 2203/0663; F17C 2205/0111; F17C 2205/0126
USPC ..... 220/560.04, 560.05, 560.07, 560.09, 220/560.1, 560.13, 560.14, 560.15, 562, 220/565, 4.12, 4.13, 4.14, 4.15
See application file for complete search history.

(56) References Cited

U.S. PATENT DOCUMENTS 3,031,856 A 5/1962 Wiedemann et al.
3,332,386 A 7/1967 Massac
(Continued)

FOREIGN PATENT DOCUMENTS

CN 202082602 U 12/2011
DE 102009002578 A1 10/2010
(Continued)

*Primary Examiner* — Robert J Hicks
*Assistant Examiner* — Kareen Thomas
(74) *Attorney, Agent, or Firm* — Mark M. Friedman

(57) ABSTRACT

This invention relate to a tank, for transport and/or storage of cryogenic gases where the tanks insulation (1) are on the inside of the tank. The tanks insulation (1) has a leak proof layer (2) made of carbon fiber, fiberglass, plastic, metal or similar leak proof material.

7 Claims, 1 Drawing Sheet

(51) Int. Cl.
*F17C 1/06* (2006.01)
*F17C 1/16* (2006.01)
*F17C 3/06* (2006.01)

(52) U.S. Cl.
CPC ..... *F17C 2205/0111* (2013.01); *F17C 2205/0126* (2013.01); *F17C 2223/0161* (2013.01); *F17C 2223/033* (2013.01); *F17C 2223/043* (2013.01); *F17C 2225/046* (2013.01); *F17C 2260/013* (2013.01); *F17C 2265/037* (2013.01); *F17C 2265/066* (2013.01); *F17C 2270/01* (2013.01)

(56) References Cited

U.S. PATENT DOCUMENTS 3,921,438 A 11/1975 Katsuta
4,021,982 A 5/1977 Kotcharian
6,047,747 A * 4/2000 Bowen ..... B23K 9/173 141/231
8,955,338 B2 * 2/2015 Jung ..... F17C 3/00 220/560.1
2008/0141684 A1 * 6/2008 Jung ..... F17C 3/00 62/48.1
2011/0302933 A1 * 12/2011 Immel ..... F17C 11/005 62/51.1

FOREIGN PATENT DOCUMENTS

GB I143288 2/1969
JP 2010023776 A 2/2010
JP 2013537961 A 10/2013
SE 468 363 12/1992
WO 2008111755 3/2008
WO 2012/032219 A1 3/2012
WO 2014006265 7/2013

* cited by examiner

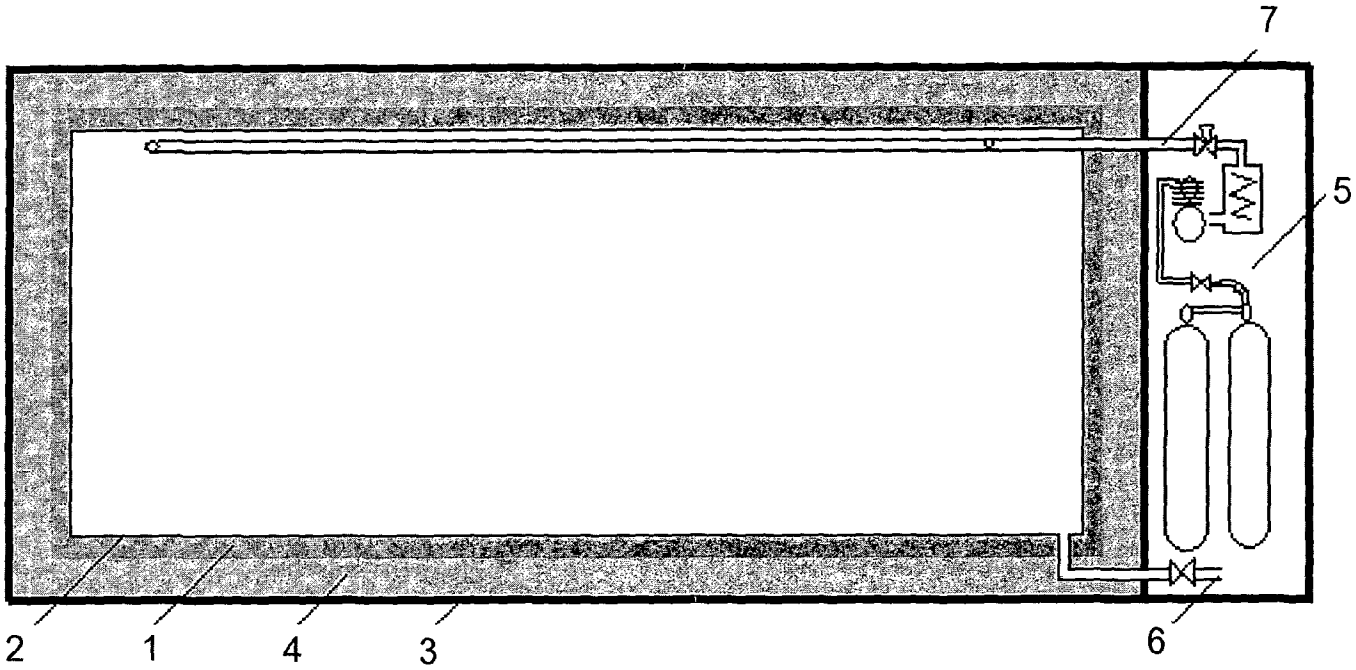
7
5
6
3
4
1
2

TANK

This invention is a tank intended to be used for transport as well as for storage of cryogenic gases where the tanks insulation is on the inside of the tank. The insulation have a leak proof layer made of carbon fiber, fiberglass, plastic, metal or similar leak proof material.

Earlier known systems are:

a) Vacuum insulated double walled tanks made of cold resistant metals.

b) Moss-Rosenberg type spherical tanks made of cold resistant metals with the insulation on the outside.

c) Membrane tanks

All the now known types of tanks for cryogenic gases are expensive because of expensive materials as well as complicated solutions:

a) Vacuum insulated double walled tanks are often pressure vessels which requires a more complicated manufacturing process. This method suits better for smaller tanks.

b) Moss-Rosenberg tanks are spherical an require therefore big space and volume.

c) Membrane tanks construction is frail because the membrane tank is made of a thin metal which does not sustain heavy loads which could occur when the tank is empty as well as when the tank will be burdened by heavy vibrations or impacts.

The characteristics for this innovation are:

That in connection to the tank is an engine room (5) which have space for collecting the "Boil-off" gas.

This inventions benefits are:

By collecting the "Boil-off gas" with high-pressure compressors which compresses the gas in to high-pressure vessels which are placed in the ends of the containers ends (engine room 5) will we get a natural friendly concept which does not release any gas to the atmosphere.

cost effective tank system with a low cost insulation the gastight tank can be manufactured of normal steel the tank can be box shaped or any shape.

the inner wooden tank is a part of the insulation a strong layer fastened to the wooden tank.

the wooden insulation will take the forces which could occur during the transport when the liquid inside the tank is moving back and forth.

The invention is more detailed explained in the enclosed drawing where an example of the tank's cross section is shown.

The tank is intended for transport and/or storage of cryogenic gases, and its insulation 1 is placed inside the tank. The insulation 1 has an inner leak proof layer 2 of carbon fiber, fiberglass, plastic, metal or similar material as the leak proof layer against the liquefied gas. The insulation 1 is of wood, e.g. thermal treated wood which have a high insulation coefficient and a small temperature expansion coefficient. Between the insulation 1 and the tanks outer skin 3 is another insulation layer 4 made of cell plastic or corresponding insulation material. The tanks outer skin 3 is a gastight steel tank. In connection to the tank is an engine room 5 with vessels for collecting the "Boil-off" gas. The reference number 6 is the Inlet/Outlet for the cryogenic liquid and number 7 is the collecting pipe for the "Boil-off" gas.

The use of this type of tanks will be more cost efficient when they will be in standardized ISO container sizes.

By collecting the "Boil-of gas" with high-pressure compressors which compress the gas in to high-pressure vessels which are placed at the container's ends (engine room 5) will a natural friendly system which does not release any gas to the atmosphere. In addition could gas driven vehicles be fuelled direct from the container by e.g. 250 bar compressed gas. The tank can be used for the most of the cryogenic gases.

The innovation can be used for different sized tanks from ISO standard container sized up to big shore terminals as well as for gas tankers. In addition could the insulation materials thickness vary depending on the need and it could be done more effective with vacuum insulation.

The invention claimed is:

1. A device for transporting and/or storing cryogenic gases, the device comprising:

a tank including an insulation layer on an inside of the tank, the insulation layer having a leak proof layer made of carbon fiber, fiberglass, plastic or metal leak proof material, the leak proof layer defining an interior space of the tank;

a plurality of pressure vessels external to the tank and deployed adjacent to the tank;

an inlet and outlet conduit for allowing flow of cryogenic gas to and from the interior space;

a collecting pipe separate from the inlet and outlet conduit for collecting boil-off gas of the cryogenic gas from the interior space, the collecting pipe including a first end deployed in the interior space and a second end deployed external to the tank, the collecting pipe in fluid flow communication with the plurality of pressure vessels; and at least one compressor coupled to the second end of the collecting pipe for compressing the boil-off gas received from the collecting pipe, the at least one compressor providing compressed collected boil-off gas to the plurality of pressure vessels for storage in the plurality of pressure vessels.

2. The device of claim 1, wherein the insulation layer is made of wood.

3. The device of claim 1, wherein the insulation layer is made of thermal treated wood.

4. The device of claim 1, wherein the tank further comprises an outer skin.

5. The device of claim 4, wherein the outer skin includes a gastight steel tank.

6. The device of claim 4, further comprising a second insulation layer interposed between the insulation layer and the outer skin.

7. The device of claim 6, wherein the second insulation layer is made of cell plastic.

* * * * *